US006631901B2

(12) United States Patent
Hess et al.

(10) Patent No.: US 6,631,901 B2
(45) Date of Patent: Oct. 14, 2003

(54) SHEET-FEEDING DEVICE

(75) Inventors: Günter Hess, Reutlingen (DE); Carlheinz Weitmann, Leonberg (DE)

(73) Assignee: Weitmann & Konrad GmbH + Co. KG, Leinfelden-Echterdingen (DE)

( * ) Notice: Subject to any disclaimer, the term of this patent is extended or adjusted under 35 U.S.C. 154(b) by 0 days.

(21) Appl. No.: 09/874,275

(22) Filed: Jun. 6, 2001

(65) Prior Publication Data

US 2002/0060409 A1 May 23, 2002

Related U.S. Application Data

(63) Continuation of application No. 09/375,810, filed on Aug. 17, 1999.

(30) Foreign Application Priority Data

Aug. 17, 1998 (DE) ..... 198 37 095

(51) Int. Cl.[7] ..... B65H 29/04
(52) U.S. Cl. ..... 271/205
(58) Field of Search ..... 271/277, 193, 271/182, 82, 85, 204, 205; 148/805, 119; 310/13; 318/38

(56) References Cited

U.S. PATENT DOCUMENTS

| | | | | | |
|---|---|---|---|---|---|
| 3,100,637 | A | * | 8/1963 | Brown | 271/205 |
| 4,081,723 | A | * | 3/1978 | Vetter et al. | 271/204 |
| 4,896,874 | A | * | 1/1990 | Muller | 271/205 |
| 5,001,980 | A | * | 3/1991 | Aoki et al. | 101/416.1 |
| 5,083,710 | A | * | 1/1992 | McLoughlin et al. | 239/124 |
| 6,092,801 | A | * | 7/2000 | Abbadessa et al. | 271/204 |
| 6,240,843 | B1 | * | 6/2001 | Kruger et al. | 318/38 |
| 6,270,076 | B1 | * | 8/2001 | Reist | 271/204 |

FOREIGN PATENT DOCUMENTS

| | | | | |
|---|---|---|---|---|
| DE | 198 26 083 A1 | * | 12/1999 | |
| SE | 53576 | * | 6/1920 | 271/205 |

* cited by examiner

*Primary Examiner*—David H. Bollinger
(74) *Attorney, Agent, or Firm*—Jones, Tullar & Cooper, P.C.

(57) ABSTRACT

The present invention relates to a sheet-feeding device for delivering printed sheets produced by a printing press, having a plurality of grippers which grasp the sheets and transport them from the printing press in the direction of a stacking device, characterized in that the sheet-feeding device is provided with at least one linear motor for transporting the grippers.

8 Claims, 4 Drawing Sheets

SHEET-FEEDING DEVICE

CROSS REFERENCE TO RELATED APPLICATIONS

Pursuant to the provisions of 35 USC 120, this application is a continuation patent application of, commonly owned patent application Ser. No. 09/375,810 filed on Aug. 17, 1999.

The disclosure contained therein, is incorporated in its entirety in this application.

FIELD OF THE INVENTION

The present invention relates to a sheet-feeding device for printed sheets in a printing press, and to a method for operating the sheet-feeding device.

BACKGROUND OF THE INVENTION

It is known for printed sheets of paper at the end of a printing press to be transferred to a sheet-feeding device, in which as a rule the sheets are powdered and then set down to form a stack. To that end, known sheet-feeding devices have revolving chains, on which grippers extending crosswise to the transport direction are secured, with which the front end edge of the sheet is grasped so that this edge can be transported through the sheet-feeding device. Such grippers have the grave disadvantage of having a relatively large structural volume, so that the powdering device must be spaced far enough away from the sheet surface that the grippers can be passed beneath the powdering device. Furthermore, the paper sheets, which are grasped merely on the front end edge, have a tendency to flutter at the usual transport speed of several meters per second in modern printing presses, which can lead to impairment of the printed image. Furthermore especially if the sheet is printed on both sides, the sheet has to be transported on an air cushion.

SUMMARY OF THE INVENTION

The object of the present invention is therefore to furnish a sheet-feeding device with which the sheet can be transported with fewer problems from the printing press until it is stacked.

This object is attained according to the present invention with a sheet-feeding device having at least one linear motor for transporting the grippers, with the grippers being secured to a carriage which is part of the linear motor, the carriages being movable on a primary part embodied as a stator.

The great advantage of the present invention is considered to be that because a linear motor is used the individual carriages can be triggered in a targeted way and thus independently of one another. In conventional sheet-feeding devices, the individual grippers are rigidly joined together by way of the revolving chains so that all the grippers have the same transport speed. In the delivery system of the present invention conversely, the carriages and thus the grippers can be triggered in a targeted way and above all are independent of one another in terms of their relative courses of motion. Furthermore, with such linear motors, relatively high speeds and very high accelerations and decelerations can be achieved. A further advantage is considered to be that such linear motors are virtually wear-free and operate with extremely little noise. Finally, by way of triggering the individual carriages, sheets of any arbitrary size, can be grasped.

BRIEF DESCRIPTION OF THE DRAWINGS

These and other features, aspects, and advantages of the present invention will become better understood with reference to the following description, appended claims, and accompanying drawings where:

DETAILED DESCRIPTION OF THE INVENTION

Figure 1:
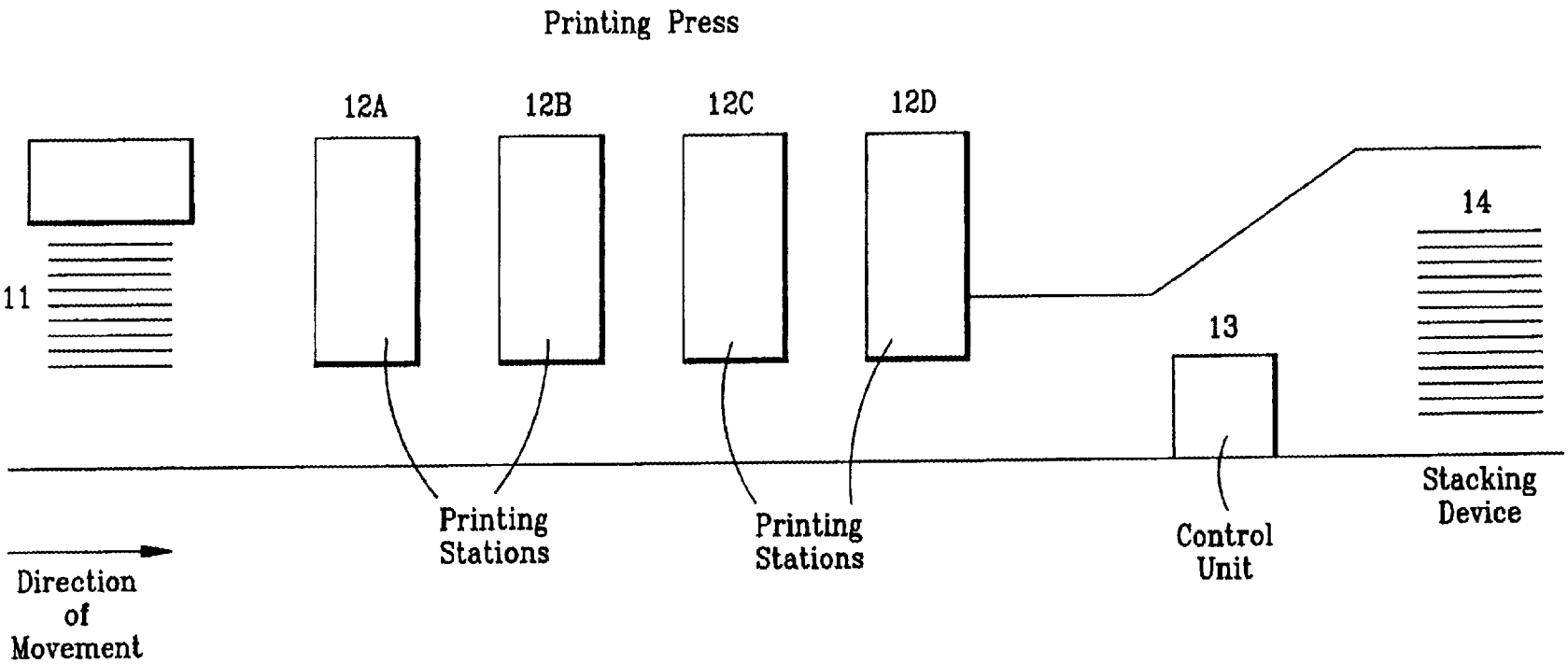
FIG. 1 illustrates, schematically, the general environment in which devices includes the present invention operate.

One embodiment according to the present invention provides that two linear motors are provided, and a plurality of carriages are movable on the two primary segments, and the sheets are grasped by means of the carriages. The linear motors can be disposed such that their spacing is variable, which makes them relatively easily adaptable to different sheet sizes.

By varying the frequency of the alternating currents fed into the primary segments, the speed of the carriage is advantageously variable. In this way the individual sheets can be transported at different speeds in certain portions of the sheet-feeding device. As a result, the sheet is handled much more gently and has less tendency to fluttering.

In one exemplary embodiment, a control unit is provided, with which individual portions or a plurality of portions of the primary segments can be triggered.

A buffer segment for the carriages is preferably provided, in which the carriages are drive-free. Along this buffer segment, the individual carriages can be ejected through an outlet gate. The sheet-feeding device is synchronized with the printing press, so that the carriages arriving at the transfer region of the sheet are adapted to the arriving sheets.

In a preferred embodiment, it is provided that the primary segments are disposed along the sheet to be transported. It is also possible for two primary segments, or in other words two transport paths, which are located one above the other to be provided on each side of the sheet. This creates the advantage that successive sheets of paper can be transported not only one behind the other but also partly overlapping. Then the front region of a sheet, for instance, is grasped by the carriage of one transport path, while the rear region of the sheet is grasped by the carriage of the other transport path, so that the sheets of paper are transported on carriages that run over different transport paths.

In another embodiment, it is provided that two transport paths located side by side are provided on each side of the sheet; once again, the front region of the sheet is grasped by a carriage of one transport path, and the rear region of the sheet is grasped by a carriage of the other transport path, and the two transport paths are spaced apart vertically from one another in the region of the stacking device, so that the, front region of the sheet has lifted slightly. In this way, successively arriving sheets can again be partly overlapped before they are set down.

Advantageously, particularly the carriages of one primary segment that engage a sheet are synchronized with the carriages of the other primary segment. In this way, relative motions of the individual carriages are avoided, so that in addition to the transport forces, only negligibly slight other forces or no other forces act on the sheets.

One exemplary embodiment provides that the gripper is provided directly on a carriage, or that the gripper is provided on a connecting element that couples two carriages together. If the gripper is provided directly on one carriage, then the long side edges of the sheet can be grasped. If the gripper is located on a connecting element, which extends crosswise to the transport direction, then both the front and rear end edges can be grasped.

The object stated at the outset is also attained by means of a method for operating a sheet-feeding device wherein the sheets are grasped on at least one side edge with separately triggerable grippers.

The method of the present invention accordingly provides that the sheet is grasped on at least one side edge with separately triggerable grippers. The term side edge is understood here to mean either the end edge or the long side edge. Via these separately triggerable grippers, it is possible as already explained above for the individual sheets of paper to be transported discontinuously. Then, however, the individual grippers are triggered not directly but rather indirectly, in that different regions of the primary segment are supplied in a targeted way with different current intensities and different frequencies.

Advantageously, each long side edge of the sheet is grasped by a plurality of grippers. In this way, fluttering of the sheet is effectively prevented, and an air cushion below the sheet can be dispensed with. In one embodiment, the long side edges of the sheet can be grasped at equal intervals.

One exemplary embodiment provides that after the gripping of the sheet, the transport speed is reduced in such a way that the front edge of the trailing sheet directly adjoins the rear edge of the leading sheet. There are accordingly no free spaces between the individual sheets. This has the substantial advantage that the powdering of the sheets can be done continuously, and in contrast to the prior art the powdering need not be done intermittently, as a function of the sheet length. This substantially simplifies the construction, triggering and embodiment of the powdering devices. Powder losses are also reduced, and soiling of both the sheet-feeding device and the printing press is reduced. Finally, this provision attains substantially more uniform powdering, so that the proportion of powder to be blown out can be adapted exactly to the sheets.

In a further embodiment it is provided that the sheets transported successively are each accelerated before being set down, and as a result the spacing between sheets is increased. This takes place following the powdering of the sheets. After this acceleration, each sheet immediately before being set down is braked by means of the carriage or carriages and then is let go by the grippers. Mechanical braking by friction is no longer necessary, and the sheets are handled substantially more gently. In this method step, the sheets are braked down to a standstill.

Advantageously, the front grippers open before the braking, and the sheet is then held only by the rearmost gripper. This has the substantial advantage that no relative forces from the plurality of grippers act on the sheet, and the sheet is then exposed only to its own force of inertia. To prevent a collision of the carriages of the leading sheet with the carriages of the trailing sheet, the carriages are moved, after the sheet has been let go, out of the region where the sheets are set down.

Specific Embodiment of the Present Invention

The foregoing description was a general description of the present invention. The following are specific embodiments of the present invention.

In FIG. 1, a conventional multi-printing press arrangement is schematically shown in which sheets from a first stack 11 are individually retrieved and feed to a series of printing presses 12A–12D. After release from the last printing press 12D, the individual sheets are stacked in a second stack 14. A control unit 13 is shown, the control unit can control individual portions or a plurality of portions.

Figure 2:
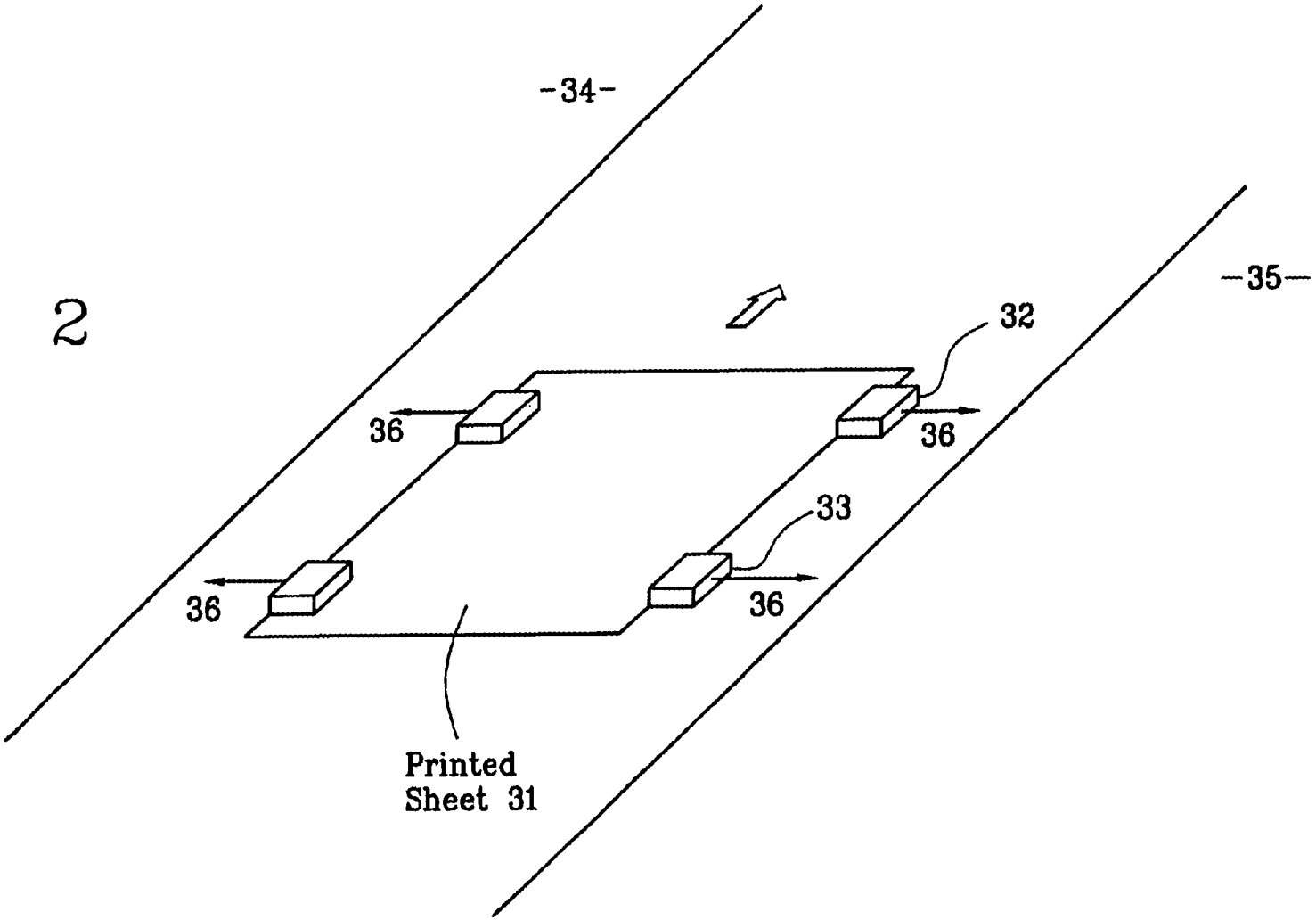
FIG 2, illustrates, schematically, a sheet being transported according to the present invention using two carriages for each side of the sheet.

In FIG. 2, a sheet is being transported by the present invention using two carriages with grippers 32 and 33 for each side of the sheet. The carriages 36 are associated with the grippers 32 and 33 and are part of a first linear motor 34 and a second linear motor 35.

Figure 3:
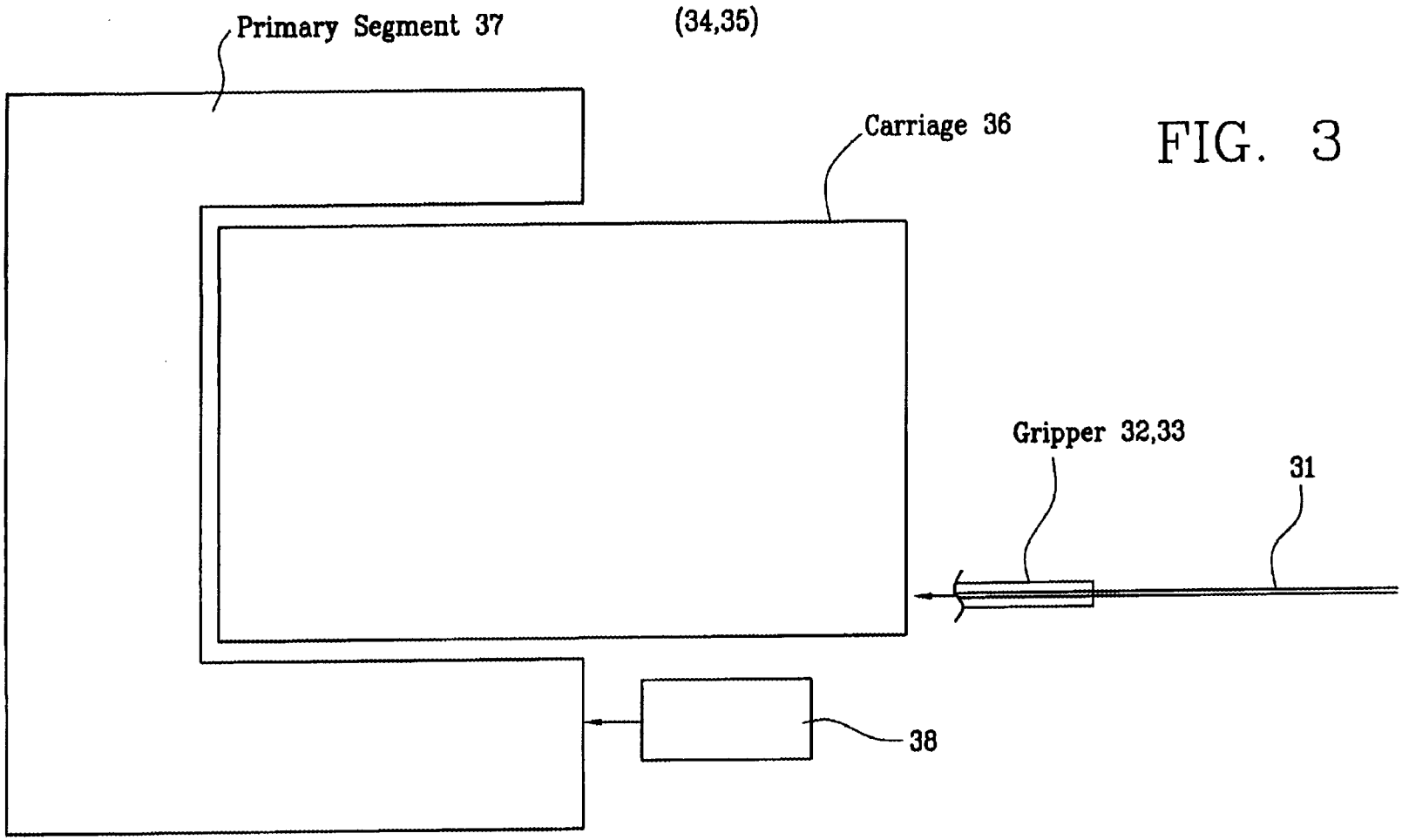
FIG. 3, illustrates, schematically, one embodiment of the sheet carriage device showing a gripper provided directly on a sheet carriage device and showing a possible arrangement of the various components of the linear motor.
Figure 4:
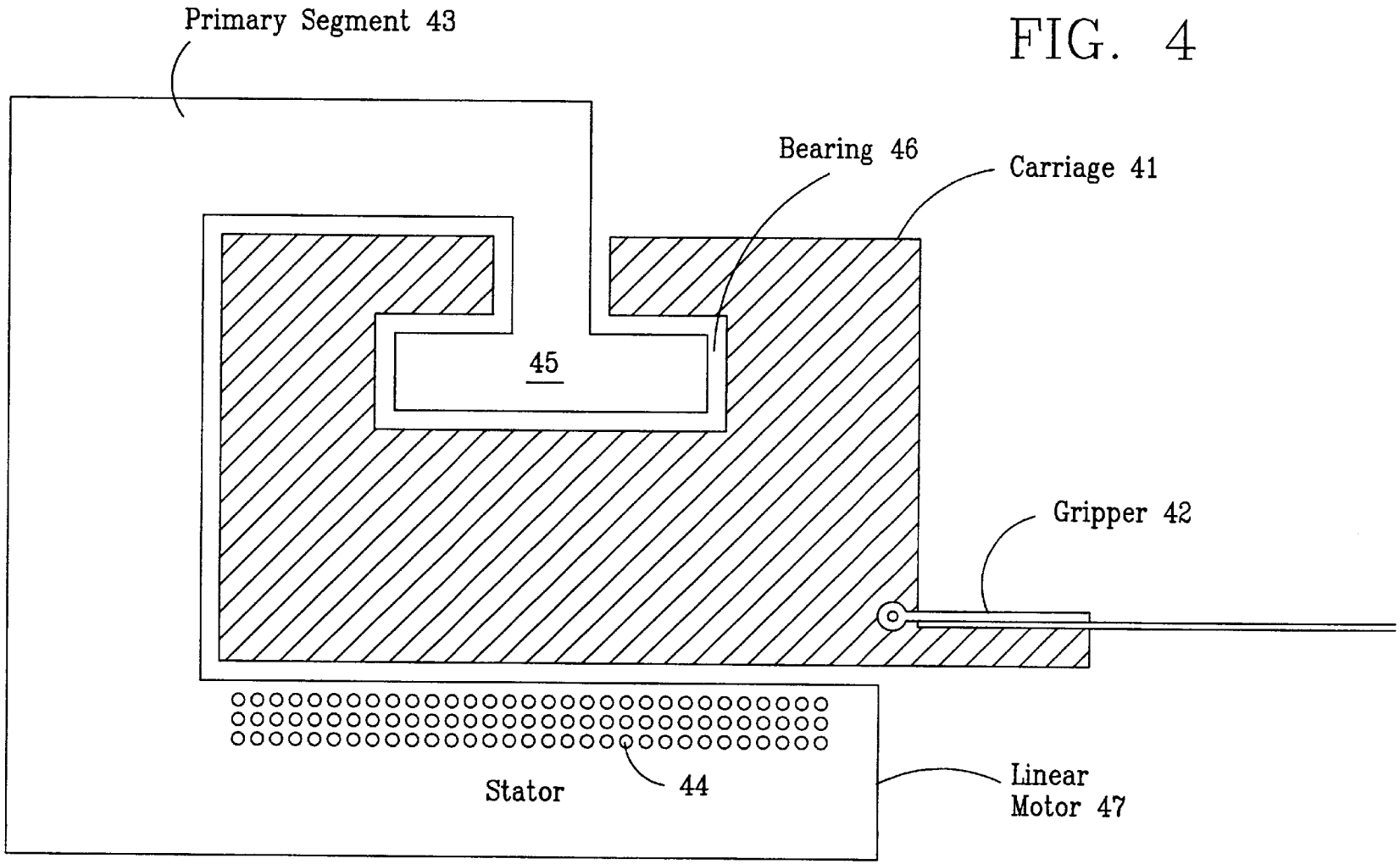
FIG. 4 is a drawing of one embodiment of the sheet carriage device showing a gripper provided directly on a sheet carriage device and showing a possible of the arrangement of the various components of a sheet carriage device.

In FIG. 3, one embodiment of a linear motor (34 or 35) having a gripper provided directly on a sheet carriage device 36 is shown. Also shown is a conventional layout of a sheet carriage device 36 of the present invention in relation to a primary segment 37. The sheet carriage device 36 includes a gripper (32,3 3) provided on the carriage device 36. Within the primary segment 37 is provided a plurality of insulated conductors which carry alternating current to provide power to the sheet carriage device 36.

Further advantages, characteristics and details will become apparent from the claims of the application.

What is claimed is:

1. A sheet-feeding device for delivering printed sheets produced by a printing press, comprising:

a plurality of grippers which grasp the printed sheets on at least one long side edge of the printed sheets and transport them from the printing press in the direction of a stacking device;

at least one linear motor for transporting said grippers, said at least one linear motor having a primary segment with a plurality of sheet carriages movable on said primary segment and on which said grippers are secured; and a controller which separately triggers the sheet carriages causing the sheet carriages to move from the printing press in the direction of the stacking device.

2. The sheet-feeding device as defined in claim 1, wherein:

a first linear motor and a second linear motor are provided for transporting grippers, said first and second linear motors each having a primary segment with a plurality of sheet carriages;

each sheet carriage has at least one gripper secured thereto, said sheet carriages being movable on respective ones of said primary segments to which they are secured; and the printed sheets are grasped on at least one of their long side edges by grippers secured to sheet carriages movable on said primary segment of said first linear motor and on the other side edge by grippers secured to sheet carriages movable on said primary segment of said second linear motor.

3. The sheet-feeding device as defined in claim 2, wherein said sheet carriages are disposed along the sheet to be transported.

4. The sheet-feeding device as defined in claim 2, wherein:

said sheet carriages of said first linear motor are synchronized with said sheet carriages of said second linear motor.

5. The sheet-feeding device as defined in claim 1, wherein:

the speed of said carriages is varied by varying the frequency of the alternating current supplied to said separately triggered primary segments.

6. The sheet-feeding device as defined in claim 1, wherein:

at least one separately triggerable primary segment is triggered via current surges and frequency.

7. A method for operating a sheet-feeding device, comprising the steps of:

grasping a printing sheet on at least one long side edge by at least one gripper which is secured to a carriage of a linear motor;

separately triggering individual sheet carriages of a primary segment of the linear motor to trigger the movement of the sheet carriage along the primary segment; and transporting the grasped sheets from a printing press in the direction of a stacking device.

8. The method as defined in claim 7, wherein:

each long side edge of a printed sheet is grasped at equal intervals.

* * * * *